US008721310B2

(12) United States Patent
Dvorak

(10) Patent No.: US 8,721,310 B2
(45) Date of Patent: May 13, 2014

(54) ROTARY MOTOR FOR COMPRESSIBLE MEDIA

(76) Inventor: Jiri Dvorak, Olomouc (CZ)

( * ) Notice: Subject to any disclaimer, the term of this patent is extended or adjusted under 35 U.S.C. 154(b) by 684 days.

(21) Appl. No.: 13/056,547

(22) PCT Filed: Mar. 3, 2009

(86) PCT No.: PCT/CZ2009/000033

§ 371 (c)(1),
(2), (4) Date: Mar. 1, 2011

(87) PCT Pub. No.: WO2010/012245

PCT Pub. Date: Feb. 4, 2010

(65) Prior Publication Data

US 2011/0171053 A1 Jul. 14, 2011

(30) Foreign Application Priority Data

Jul. 29, 2008 (CZ) ..... 2008-465

(51) Int. Cl.
*F04C 2/00* (2006.01)

(52) U.S. Cl.
USPC ..... 418/150; 418/164; 418/166

(58) Field of Classification Search
USPC ..... 418/150, 160, 161, 164, 166
See application file for complete search history.

(56) References Cited

U.S. PATENT DOCUMENTS 748,348 A * 12/1903 Cooley ..... 418/166
914,627 A * 3/1909 Aloorn ..... 418/166
1,700,038 A 1/1929 Feuerheerd (Continued)

FOREIGN PATENT DOCUMENTS

CZ 296 486 3/2006
EP 1 084 334 3/2001

(Continued)

OTHER PUBLICATIONS

International Search Report mailed Nov. 6, 2009 for International Application No. PCT/CZ2009/000033.

*Primary Examiner* — Mary A Davis
(74) *Attorney, Agent, or Firm* — Buchanan Ingersoll & Rooney PC

(57) ABSTRACT

A rotary motor for compressible media, containing at least one impellor and at least one stator mounted between two mutually coupled and concurrently mounted bearing plates, adjusted for a mounting of double sided led out driving shaft of the impellor on which is mounted a rotary piston mounted in a chamber of the stator equipped with sealing lids, wherein the rotary piston with elliptical crosscut is mounted into symmetrically shaped triangular chamber equipped with rounded peaks, when each of them is equipped with at least one port for an entry and an exit of the compressible media, in way that a lengthwise axis ($o_p$) of the rotary piston which is identical to the driving shaft axis is due to reach of simultaneous circular movement of the stator in contra direction to the rotary piston rotating namely at parallel advance of all points of the stator along the circle with eccentricity radius (e) and is moved with regard to a lengthwise axis ($o_s$) of the chamber of the stator of the value of an eccentricity (e), whereas to one of the bearing plates is on the driving shaft mounted central cog wheel on whose perimeter are mounted three satellite cog wheels, which are firmly mounted on pegs pivoted in the bearing plate and coupled with the stator by the help of the drive pins fixed in the stator with eccentricity (e) regarding to the pegs axes.

3 Claims, 6 Drawing Sheets

(56) References Cited

U.S. PATENT DOCUMENTS

| | | | | | |
|---|---|---|---|---|---|
| 1,753,476 | A | * | 4/1930 | Richer | 418/150 |
| 2,965,039 | A | * | 12/1960 | Yoshinori | 418/166 |
| 3,221,664 | A | | 12/1965 | Jernaes | |
| 3,253,583 | A | * | 5/1966 | Satoru | 418/166 |
| 3,474,954 | A | * | 10/1969 | Linder | 418/166 |
| 3,514,236 | A | * | 5/1970 | Rashev | 418/160 |
| 4,540,356 | A | * | 9/1985 | Wankel | 418/164 |
| 4,551,073 | A | * | 11/1985 | Schwab | 417/352 |
| 4,797,077 | A | | 1/1989 | Anderson | |
| 5,174,742 | A | | 12/1992 | Putney | |
| 5,399,078 | A | * | 3/1995 | Kuramasu | 418/150 |
| 5,527,165 | A | * | 6/1996 | Schadeck | 418/36 |
| 6,974,313 | B2 | * | 12/2005 | Beaudoin | 418/54 |

FOREIGN PATENT DOCUMENTS

| | | |
|---|---|---|
| JP | 6-17601 | 1/1994 |
| JP | 7-247949 | 9/1995 |
| JP | 11-173101 | 6/1999 |
| WO | WO 91/14081 | 9/1991 |
| WO | WO 99/63206 | 12/1999 |

* cited by examiner

ROTARY MOTOR FOR COMPRESSIBLE MEDIA

THE FIELD OF THE INVENTION

This invention concerns a construction of a rotary motor for compressible media, especially of the motors driven by compressible gas or steam.

THE PRESENT PRIOR ART

Current known constructions of a classic air or steam motors contain a crank mechanism and a reversible moving piston, whose disadvantages are high-energy losses at change of direction of the piston. Similar solutions are motors where the crank mechanism is replaced by a skew plate. There is also a solution according to the file EP 1084334 with a special crank mechanism, which enables a delay of a piston at its top dead centre, where compressible air is released in front of the piston, the compressible air sets, by its expansion, the piston back to a motion. This solution is technically very difficult and the motor shows a low efficiency.

Further known constructions of rotary air motors use eccentric mount of an impellor and movable seal lamellas, as it is described in the files U.S. Pat. No. 5,174,742, JP 11173101 or JP 7247949. In these solutions is impossible to use whole travel of a rotation to transfer of energy and this concludes in a lower efficiency. Further disadvantage of these solutions is higher wear-off of the sealing lamellas and a necessity of their lubrication and the necessity of use of special constructional materials, which leads to a higher production demands.

Finally there are known solutions of rotary air motors with two or more shaped impellors, which at a rotation create flexible variable work spaces as for example in construction according to the files JP 6017601, CS 173441, CZ 296486 or U.S. Pat. No. 4,797,077. According to these solutions is again impossible to use a whole travel of rotation to energy transfer. Further disadvantages are big areas with a seal necessity, bigger total weight of the motors and a high production demand. Finally is known solution of a rotary piston motor according to the invention U.S. Pat. No. 3,221,664where a rotary piston makes compound rotary and circular simultaneous movement namely by the help of eccentrically set pegs on three satellite wheels, which are in gear with inner teeth placed in bearing board fixed with an immobile stator. Satellite wheels then roll away along inner teeth and their central pegs, imbedded into central shaft flange, are moving along the circle and herewith drag the central shaft into rotary movement. Sealing lids are fixed with the rotary piston and herewith they move along front surfaces of the stator. Circular cuttings in the sealing lids secure at its movement inflow and outflow of pressure media from the attachments. Disadvantage of this solution is quite difficult construction, but especially transmission of whole arising gyroscopic moment from the rotary piston on central shaft.

A task of a presented invention is to introduce a new simple construction of a rotary motor with a minimal amount of moving parts, which does not need to its working for mechanical splitting of working periods any special parts, it is simple for a production, shows high working efficiency and reliability and is environmental friendly.

THE ESSENCE OF THE INVENTION

Defined goal is reached by the invention of a rotary motor for compressible media containing at least one impellor and at least one stator, mounted between two mutually coupled and in parallel mounted bearing plates, adjusted for a mounting of two sided made drive crank of the impellor, on which is mounted a rotary piston mounted in a stator chamber equipped with sealing lids. An essence of the invention is that rotary piston with an elliptical cross cut is mounted in symmetrically shaped triangular chamber equipped with rounded peaks, from which each is equipped with at least one port for entry and exit of compressive media that way, that its lengthwise axis ($O_p$) which is identical to the axis of driving shaft, is due to the reach of simultaneous rotary movement of the stator in counter direction to rotation of rotary piston namely at parallel advance of all the points of the stator along the circle with eccentricity radius (e) moved with regard to the lengthwise axis of the chamber of the stator of eccentricity value, to achieve this is to one bearing plate on the crank mounted central cog wheel, on its perimeter are evenly placed three satellite cog wheels, which are fixed on pegs rotary mounted in the bearing plate and coupled with the stator by the help of drive pins, fixed to the stator with eccentricity (e) regarding to pegs axes.

Further essence of the invention is that the rotary piston is created in a way that between big axis (a) and small axis (b) of an ellipse and an eccentricity (e) is relation $$a=b+2e,$$

whereas partly rounded peaks of the chamber are mutually swung of 120° and are made in a distance ($v_v$) from lengthwise axis ($O_s$) of the chamber of the stator with value $$v_v=a+e,$$

partly a rounding of the peaks of the chamber corresponds with rounding of the rotary piston, partly the walls of the chamber opposite to the peaks are made in a distance ($v_s$) which corresponds with a radius of an inscribed circle and has value $$v_s=b+e$$

and partly the transition parts of the chamber surface between the peaks and the walls are created with an envelope curve made by moving rotary piston.

Finally the essence of the invention is that satellite cog wheels are equipped with half number of the teeth than the central cog wheel and their pegs are mounted in the bearing plate with the help of the peg bearings, where each peg is on its outer front equipped with fixation opening created with an offset of the eccentricity (e) value, whereas in each fixation opening is mounted guide bearing for mounting of drive pins, which are mounted in the stator on the same spacing as satellite cog wheels.

Next advantages of this solution are setting of movable parts in the bearings, easy possibility of their accurate working and synchronically directed movement, which enables creation of minimal clearance between the rotary piston and the stator. The rotary piston can then turn without inside touch of the stator, which increases total efficiency and working life of the motor. Thereby falls off necessity of a lubrication of contact areas what is advantageous especially for steam running. Considerable advantage is a possibility to reach dynamic balance of rotating motion of the stator at parallel advance of all its points along the ciecle with eccentricity radius (e) only by adding of one or more rotary pistons on the crank and joining of given stators with synchronic mechanism thus with the sets of the cog wheels and their relevant drive pins. At the same time, the motor has very easy possibility of reversion of rotation direction by simple change of a timing of by-pass valves. From an environmental point of view, there is another advantage of this solution and this is relatively low noisiness of the motor and an absence of exhalations at running. When use self-lubricating bearings and plastic central cogwheel the motor can work completely without oil.

DESCRIPTION OF THE DRAWINGS ON ENCLOSED PICTURES

The particular case of the motor construction according to the invention is sketchy illustrated on enclosed drawings where:

EXAMPLES OF DESIGN OF THE INVENTION

Figure 1:
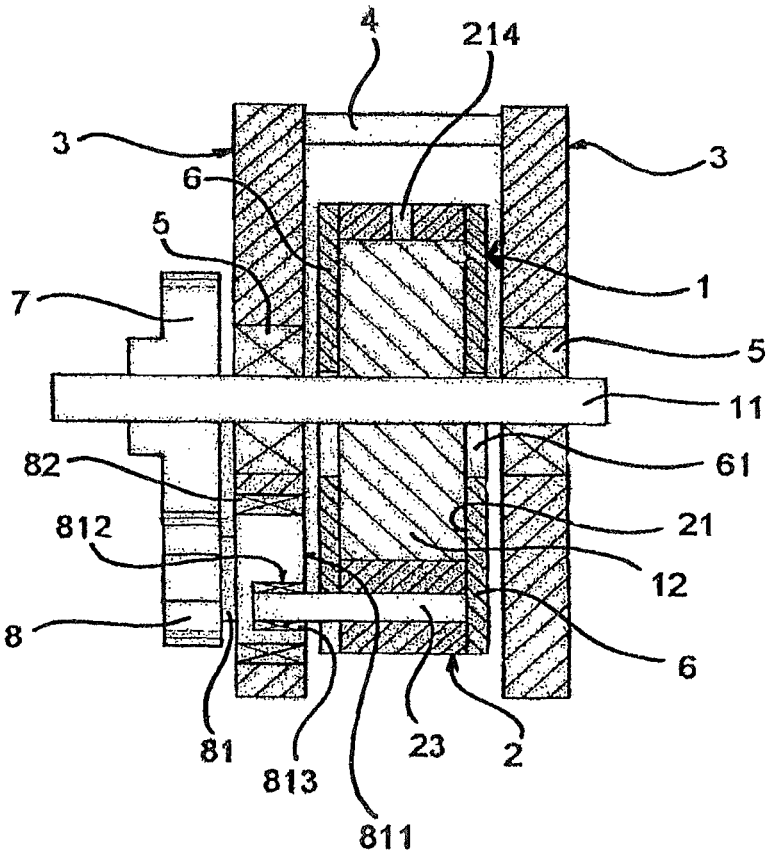
FIG. 1 is vertical lengthwise cut of the motor
Figure 2:
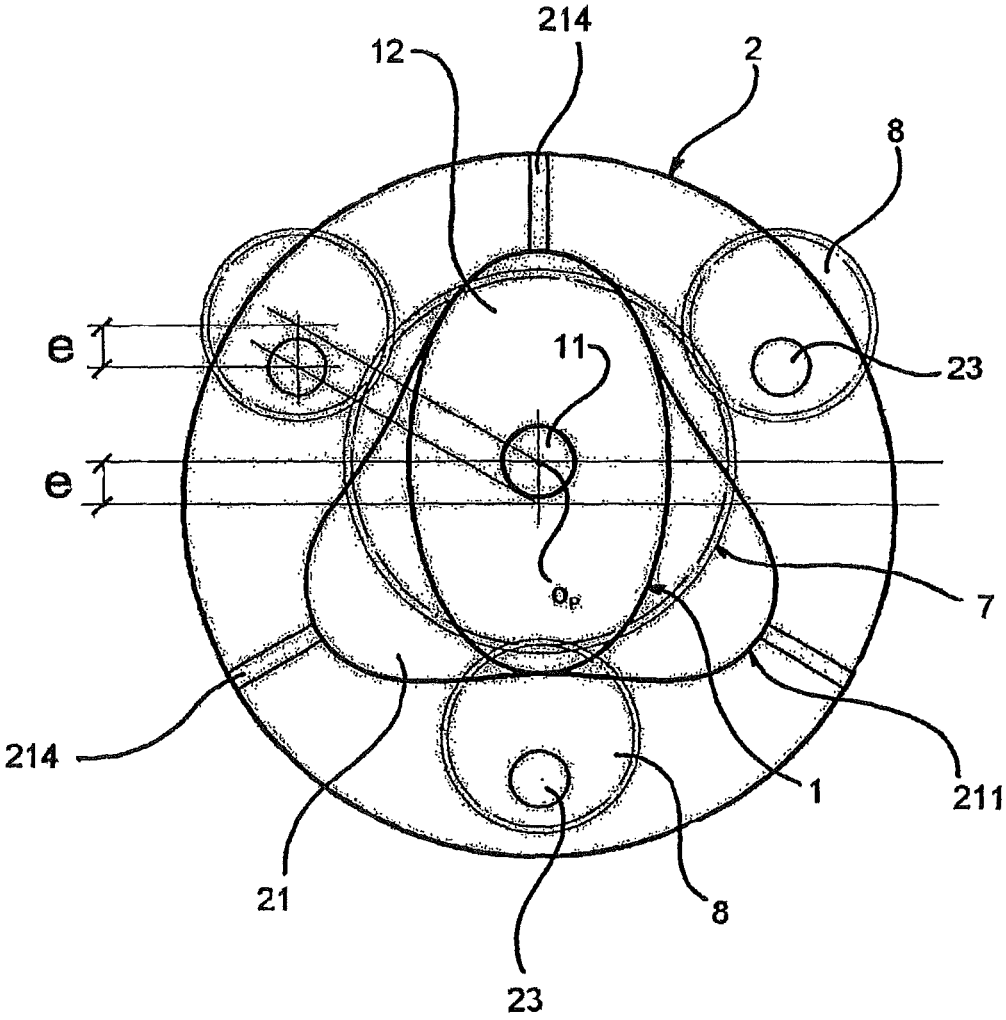
FIG. 2 is sketchy side view of the motor from the side of central cogwheel

The rotary motor consist of an impellor 1 and a stator 2, which are mounted between two simultaneously mounted bearing plates 3, which are mutually coupled by spacing elements 4 for example by bolts, evenly set in their peripheral part. In central part of the bearing plates 3, are mounted shaft bearings 5, in which is mounted two side designed driving shaft 11 of the impellor 1, on which is axially aligned mounted rotary piston 12 with an elliptical cross cut, which is made in a way that between big axis a and small axis b of an ellipse and an eccentricity e is relation.

The rotary piston 12 is mounted in a triangular chamber 21 of ring stator 2, to whose front surfaces 22 are two-side mounted, preferably bolted, sealing lids 6 equipped with centric openings 61 for enabling of free passing of a driving shaft 11. A shape of the chamber 21 of the stator 2 is made in a way that consists of three symmetric parts, whose rounded peaks 211 are mutually swung of 120° and are made in a distance $v_v$ from lengthwise axis $o_s$ of the chamber 21 of the stator 2, which has value $$v_v=a+e,$$

whereas rounding of a peak 211 of the chamber 21 matches rounding of the rotary piston 12. Walls 212 of the chamber 21 facing the peaks 211 are made in a distance $v_s$, which matches radius of inscribed circle and has value $$v_s=b+e.$$

Figure 3:
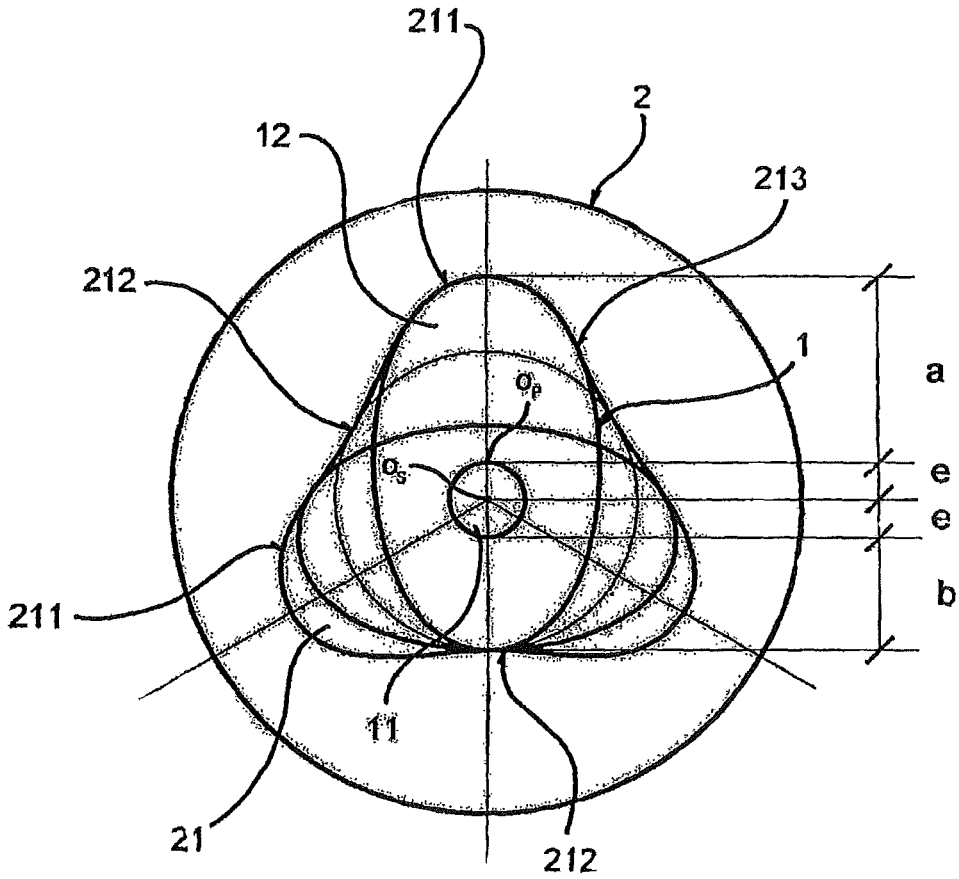
FIGS. 3 to 5 are geometric schemes of the impellor and the stator for creation of the shapes of an ellipse impellor piston, triangular chamber of the stator and cover curves of stator chamber
Figure 4:
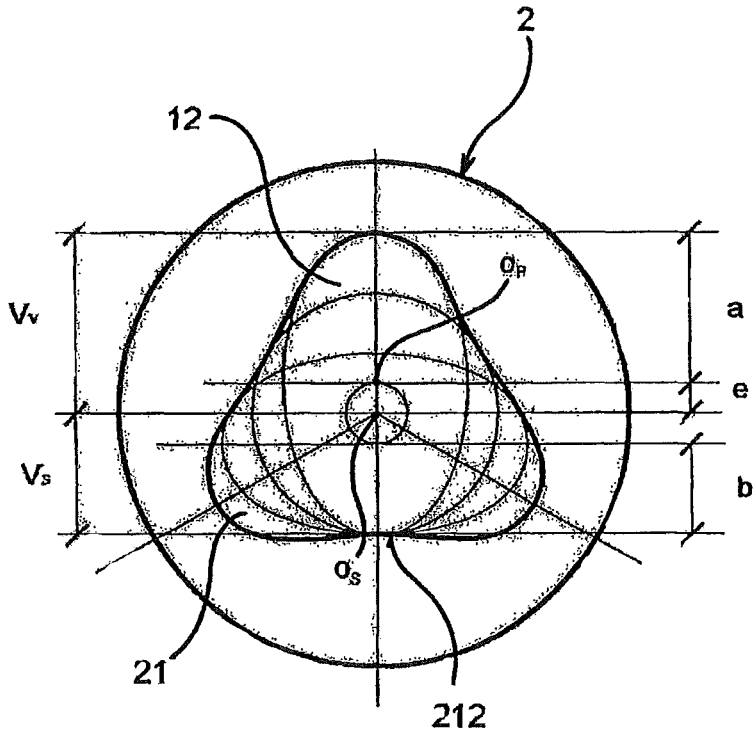
Figure 5:
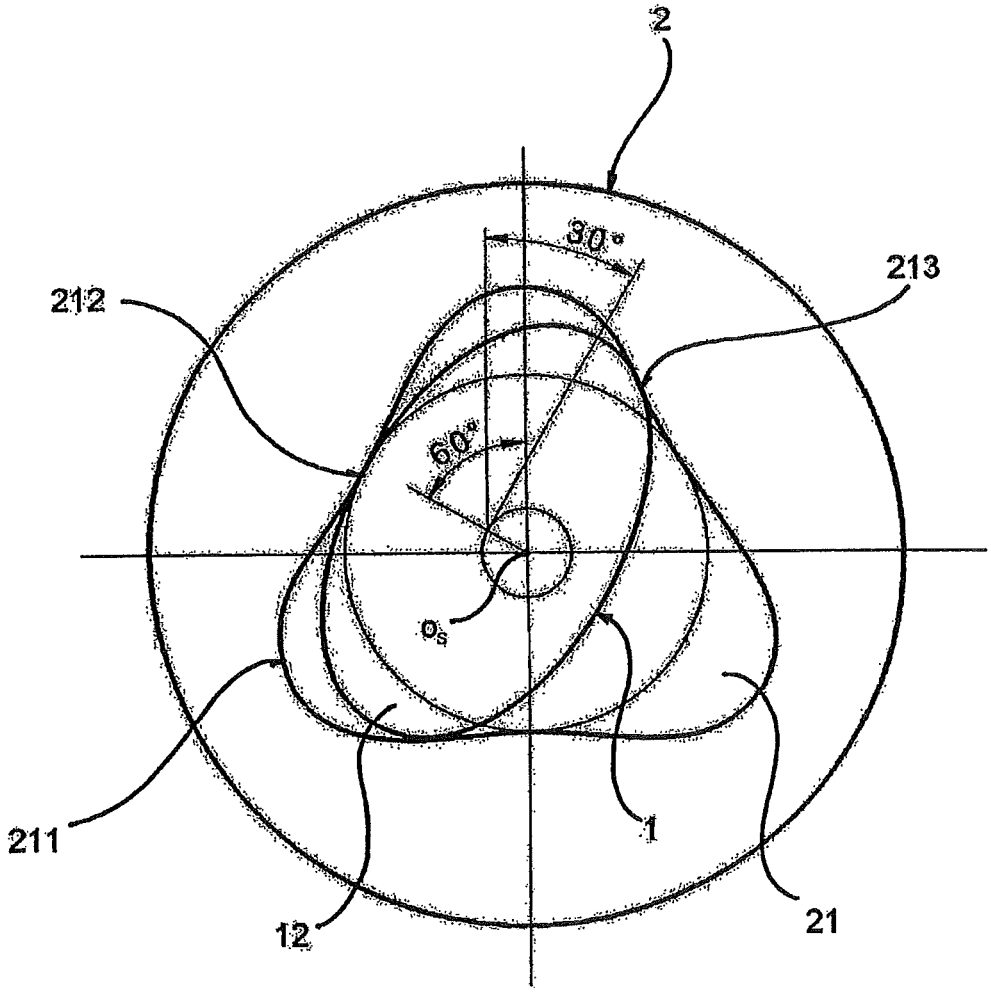

Transition parts 213 of the chamber 21 between the peaks 211 and the walls 212 are made by an envelope curve of moving rotary piston 12, whose lengthwise axis $o_p$ is moved with regard to the lengthwise axis $o_s$ of the chamber 21 of the stator 2 of value of the eccentricity e as it is clear from FIGS. 3 to 5. In every peak 211 is made at least one port 214 for entry and exit of working media.

From the outer side of one of the bearing plates 3 is on the driving shaft 11 mounted central cogwheel 7 around its perimeter are evenly with angle 120° set three satellite cog wheels 8 equipped with half number or teeth than the central cogwheel 7. The satellite cog wheels 8 are fixed on pegs 81, which are pivoted, for example by the help of pivot bearings 82 in the bearing plate 3. Each of the pegs 81 is on its outer face 811 equipped with fixation opening 812 made with offset with value of eccentricity e. In each of the fixation openings 812 is mounted guide bearing 813 for fixation of drive pins 23, which are mounted, for example pressed in, inside of the stator 2 on the same spacing as the satellite cog wheels 8 and serve to transfer of rotary movement of the stator 2 on the drive crank 11.

From above mentioned it is perceptible that comprehensive description of the rotary motor is performed only on the surface and does not solve further related and non-illustrated constructional parts such as by-pass valves, including their control and inlet, lubrication, cooling, balance wheel and so on, which do not have influence on the essence of presented solution. Likewise the use of the name Stator 2 for circularly moving element is conscious aim of the inventor, for this element really makes the stator 2 function regarding to the contra directionally rotating rotary piston 12.

At producing of an elliptical shape of the rotary piston 12 and a shape of the triangular chamber 21 of the stator 2 the main parameter for evaluation of size of the rotary motor is selectable value of an eccentricity e, thus displacement of the axis $O_s$ of the triangular chamber 21 of the stator 2 to the axis $O_p$ of the rotary piston 12. In optimal case of choice of cut of the rotary piston 12 is length a of big axis of the ellipse five to six times bigger than value of the eccentricity e, small axis b then must at the turn of the rotary piston 12 of 90° touch the walls of the triangular chamber 21 and is smaller of double value of the eccentricity e. The triangular chamber 21 is formed in a way that transmission curve between the rounded peaks 211 and the walls 212, dimensionally specified by a inscribed circle forms the envelope curve of the rotary piston 12 rotating with double speed than simultaneously in counter direction rotating stator 2 on the radius of the eccentricity with the radius of the eccentricity e. Compound movement of the rotary piston 12 and the stator 2 is possible to substitute with the solution where the stator 2 is fixed and the rotary piston 12 makes planetary movement, when the centre of the ellipse is moving along a circle with radius of the eccentricity e in given angle and at the same time the axis $O_p$ of the ellipse, thus the rotary piston 12 is swiveling in counter with opposite direction with halfway angle as is visible in FIG. 5. This way it is possible to find out the most distant points of contact of the ellipse, by whose tangential joining with the rounded peaks 211 arises the envelope curve, which is on the opposite side in contact with side part of the ellipse of the rotary piston 12.

Figure 6:
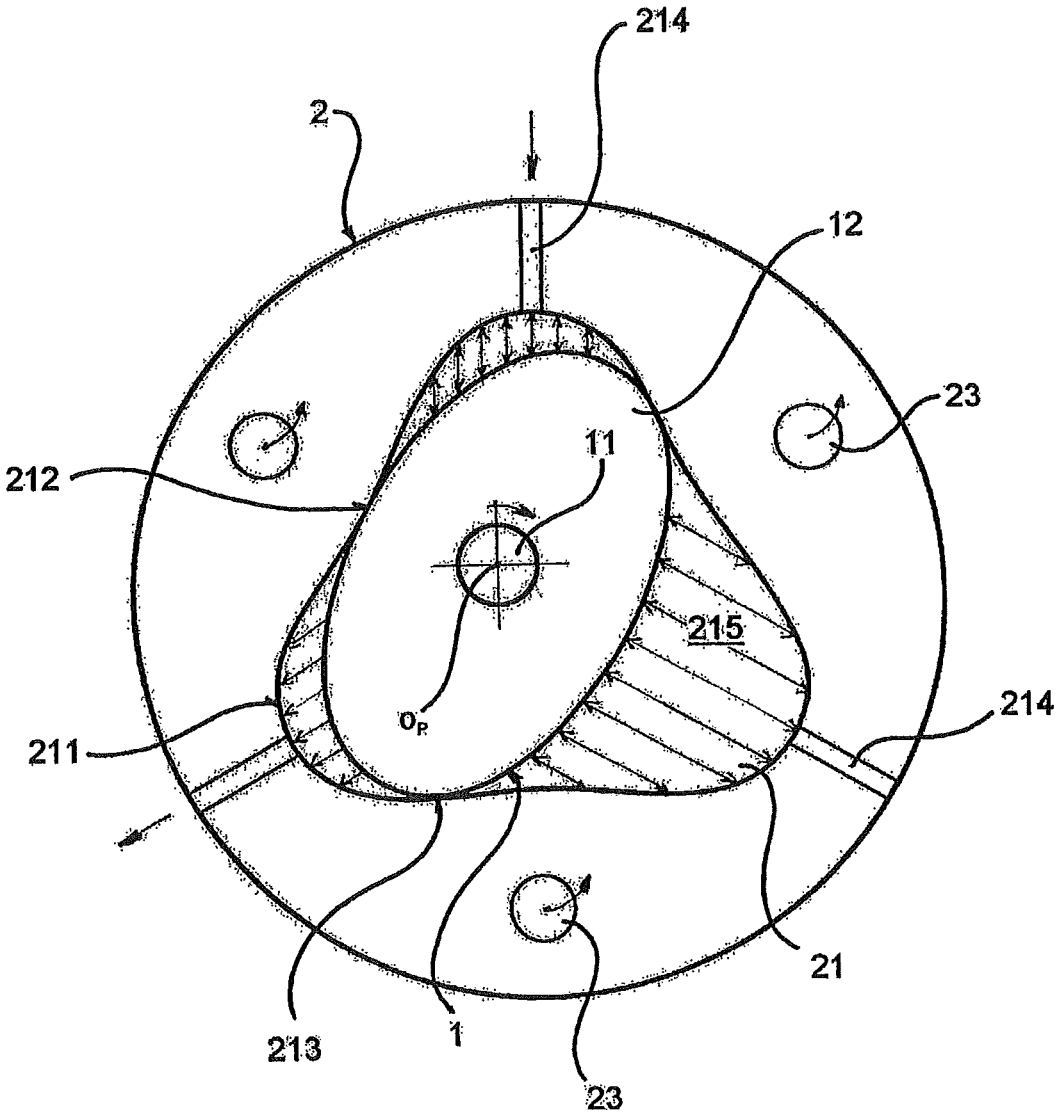
FIG. 6 illustrates particular phases of working motor.

Working of the motor is possible to recognize from a position of the rotary piston 12, which is with its one arch in the one peak 211 of the stator 2, where it blocks given port 214 for entry of compressive media, whereas is by its surface in bilateral symmetrical contact with the walls 212 of the stator 2. At swivel of the rotary piston 12, illustrated in FIG. 6, its contact points with both walls 212 start to recede and in the chamber 21 arises a working space 215, where through adjacent port 214 via non-illustrated by-pass valve starts to enter working medium, which by its expansion swivels the rotary piston 12 to maximal possible capacity, which is at swivel of the rotary piston 12 of 90°. Simultaneously is, on the opposite part of the rotary piston 12, being finished previous working cycle in the working space 215 by the second peak 211, which is emptied via given port 214. After emptying the rotary piston 12 near the peak 211 comes to home position and the process is repeated in above mentioned way. With regard to a triangular shape of the chamber 21 then comes to entry of the compressive media against the direction of rotating of the rotary piston 12 always after its swivel of 60° that means six times for one rotation. It is perceptible that particular working cycles run in the working spaces 215 of relevant peaks 211 and coincide with each other, because the maximal working space 215 is reached at swivel of the working piston of 90°, but already at its swivel of 60° starts next working cycle by neighboring peak 211.

Described constructional solution is not the only possible design of the rotary motor, when in dependence on its size and required load it is possible to make in each peak instead of one two ports 214 for separate entry and exit of the compressive media and also the design and coupling of the bearing plates 3 can be different in dependence on particular constructional design of the impellor 1 and the stator 2.

The Industrial Application

The rotary motor according to the invention is possible to use in different branches of an industry and transport as ecologically friendly drive unit of machines, vehicles and other devices.

The invention claimed is:

1. A rotary motor for compressible media comprising:

an impellor and a stator mounted between two mutually coupled and concurrently mounted bearing plates in which is mounted a driving shaft of the impellor, the driving shaft having a rotary piston mounted thereon in a chamber of the stator, the stator being equipped with sealing lids, wherein the rotary piston has an elliptical crosscut and is mounted into the chamber, the chamber being a symmetrically shaped triangular chamber equipped with rounded peaks, each of the rounded peaks being equipped with at least one port for an entry and an exit of the compressible media, the rotary piston being mounted such that a lengthwise axis $o_p$ of the rotary piston is coaxial with a driving shaft axis, the stator rotating in a circular movement in a direction opposite of the rotary piston, wherein the rotary piston rotates at a parallel advance of all points of the stator along a circle with an eccentricity radius e and is moved in relation to a lengthwise axis $o_s$ of the chamber of the stator of the value of the eccentricity radius e, wherein one of the bearing plates is on the driving shaft mounted central cog wheel, the central cog wheel having three satellite cog wheels mounted on a perimeter thereof, which are firmly mounted on pegs pivoted in each of the bearing plates and coupled with the stator by drive pins fixed in the stator and each of the drive pins are spaced the eccentricity radius e from a peg axis.

2. The rotary motor according to the claim 1, wherein the rotary piston is made in a way that between a big axis a and a small axis b of an ellipse and the eccentricity radius e has a relationship:

$$a=b+2e,$$

wherein the rounded peaks of the chamber are mutually swung of 120° are made in a distance $v_v$ from the lengthwise axis $o_s$ of the chamber of the stator, which has the value $$v=a+e,$$

the peaks of the chamber correspond with the rotary piston, walls of the chamber opposed to the peaks are made in a distance $v_s$, which corresponds with a radius of an inscribed circle and has the value $$v_s=b+e$$

and transitional parts of the chamber surface between the peaks and the walls are made by an envelope curve made by movement of the rotary piston.

3. The rotary motor according to claim 1, wherein the three satellite cog wheels are equipped with half the number of teeth of the central cog wheel and the pegs are mounted in each of the bearing plates by the help of pivotal bearings, wherein each of the pegs is equipped with a fixation opening made with an offset of the eccentricity radius e on an outer face thereof, and wherein each of the fixation openings is mounted a guiding bearing for mounting of the drive pins, which are mounted in the stator on the same spacing as the three satellite cog wheels.

* * * * *